United States Patent [19]

Monson

[11] 4,095,796

[45] Jun. 20, 1978

[54] DICE SHAKER

[76] Inventor: Marvin Monson, 4524 Montview Blvd., Denver, Colo. 80207

[21] Appl. No.: 738,140

[22] Filed: Nov. 2, 1976

[51] Int. Cl.[2] ..... A63F 9/04

[52] U.S. Cl. ..... 273/145 C

[58] Field of Search ..... 273/144 R, 144 B, 144 A, 273/145 R, 145 B, 145 A, 145 C, 145 CA, 145 D, 145 E

[56] References Cited

U.S. PATENT DOCUMENTS

| | | | |
|---|---|---|---|
| 500,478 | 6/1893 | Edge et al. | 273/145 C X |
| 502,876 | 8/1893 | Cahoon, Jr. | 273/145 C X |
| 954,070 | 4/1910 | Zschau | 273/145 C |
| 1,588,698 | 6/1926 | Boyd et al. | 273/144 A |
| 2,724,595 | 11/1955 | Amann | 273/145 A |
| 2,792,227 | 5/1957 | Auerbach | 273/144 A X |
| 3,095,655 | 7/1963 | Berglund et al. | 273/144 B X |
| 3,892,410 | 7/1975 | Hoetzel | 273/145 C |
| 3,905,603 | 9/1975 | Hoetzel | 273/145 C X |

FOREIGN PATENT DOCUMENTS

| | | | |
|---|---|---|---|
| 130,181 | 11/1948 | Australia | 273/144 R |

*Primary Examiner*—Richard C. Pinkham
*Assistant Examiner*—Arnold W. Kramer
*Attorney, Agent, or Firm*—Wm. Griffith Edwards

[57] ABSTRACT

A device for mixing one or more dice, used in a game including a container whose interior is divided into a display chamber and a mixing chamber by an interior partition. Mixed dice are passed one at a time through a slot in the partition from the mixing to the display chamber and prevented from returning by a slidable closure within the interior of the container to hold the mixed dice captive so they can be displayed to participants of the game.

5 Claims, 5 Drawing Figures

DICE SHAKER

BACKGROUND OF THE INVENTION

This invention relates to an amusement device, and more particularly, a device for shaking dice used in a variety of games of chance.

Many games, such as backgammon, require the user of dice to determine the movement of gamepieces about a gameboard. The dice, if not stored properly, are often misplaced and lost or even when available, are often thrown off the gameboard when tossed delaying the game until they are recovered. This invention provides a container for storing and selectively displaying such dice and a sealed container in which the dice can be mixed without fear of losing the dice.

SUMMARY OF THE INVENTION

In accordance with the invention, a rectangular container decorated with indicia representative of the spots on a pair of dice is provided with a transparent window at one end and a plugged hole at an opposite end to receive one or more dice within the container. An interior partition within the interior of the container divides the interior of the container into a die mixing chamber and a die display chamber adjacent the window. The partition has a slot which selectively establishes communication between the mixing and display chambers, and enables one die at a time to pass and tumble from the mixing chamber to the display chamber. A panel is supported in the mixing chamber in tracks on the top and bottom of the container for sliding movement to cover the communication slot to lock the dice in viewing position in the display chamber.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
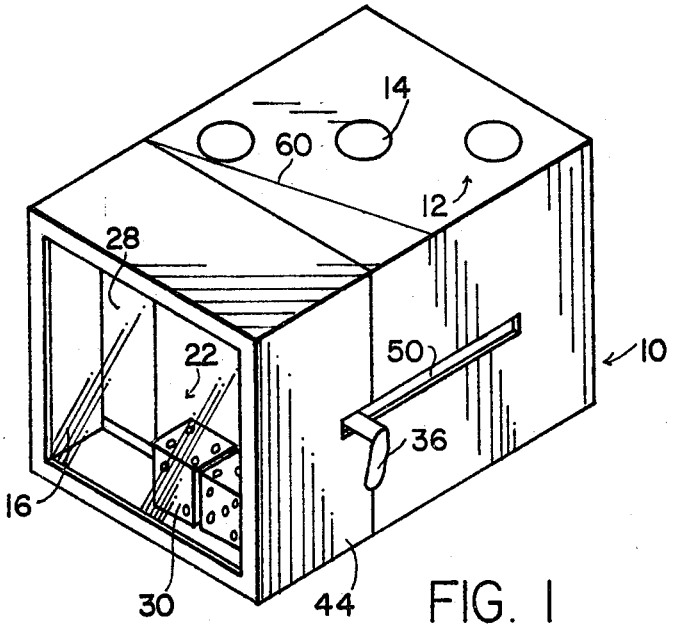
FIG. 1 is a perspective view of the dice shaker of the present invention.
Figure 2:
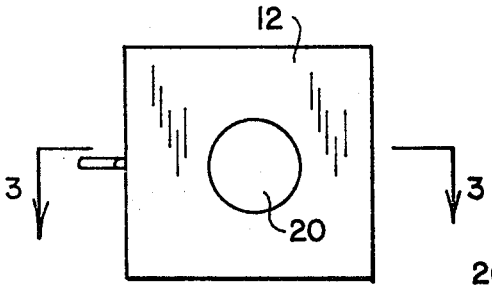
FIG. 2 is a rear view in elevation of the dice shaker of FIG. 1.
Figure 3:
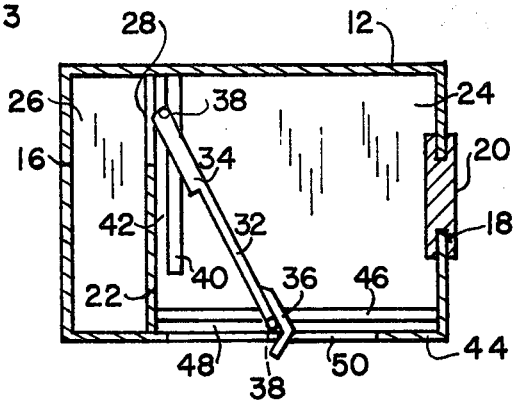
FIG. 3 is a cross-sectional view taken substantially along the plane indicated by line 3—3 of FIG. 2.
Figure 4:
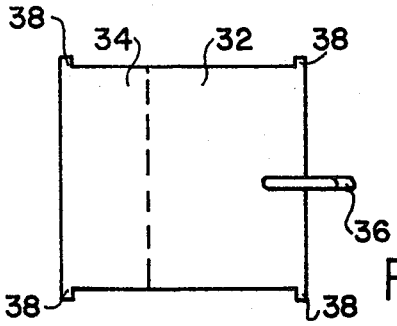
FIG. 4 is a top plan view of a slidable locking panel in the interior of the dice shaker of FIG. 1.

Referring now to the drawing in detail, wherein like numerals indicate like elements throughout the several views, the dice shaker 10 of the present invention includes a rectangular parallelopiped container 12 decorated with indicia 14 representative of the spots on a pair of dice.

Container 12 is provided with a transparent window 16 at one end and a hole 18 at its other end adapted to be covered with a solid rubber plug 20. Hole 18 receives one or more dice to be mixed within container 12.

An interior partition 22 within container 12 divides the interior of container 12 into a die mixing chamber 24 and a die display chamber 26 adjacent window 16. Partition 22 has a slot 28 which selectively establishes communication between the mixing and display chambers 24, 26 and enables one die 30 at a time or a plurality of dice mixed in chamber 24 to pass and tumble from chamber 24 to display chamber 26 the number of dice at one time depending upon the length of the slot 28.

A panel 32 is slidably supported in mixing chamber 24 to cover slot 28 in partition 22 to lock the dice 30 passed to the display chamber 26 in the display chamber so container 12 can be lifted to show the dice 30 to the game participants without fear that they will return to the mixing chamber 24. The width of chamber 26 is such that once a die 30 is passed to the display chamber and the slot 28 has been closed by the panel 32, the die cannot turn, but is locked in position so that it cannot change its uppermost face.

Panel 32 is substantially rectangular in plan, but includes a thickened portion 34 adapted to close slot 28 and a handle or lever 36 extending from an opposite edge. Tabs 38 extend from each corner of panel 32.

Tabs 38 on panel 32 are positioned between the partition 22 and a strip of material 40 parallel to the partition 22 on the interior floor and ceiling of container 12 forming a track 42 and a side wall 44 of container 12 and a strip of material 46 parallel to side wall 44 on the interior floor and ceiling of container 12 forming a track 48. Lever 36 extends through an elongated slot 50 in side wall 44.

Upon sliding lever 36 rearwardly in slot 50, panel 32 will slide limitedly in tracks 42 and 48 to expose slot 28 in partition 22 to enable the dice 30 to be selectively passed into display chamber 26 after they are shaken and mixed in chamber 24. By returning lever 36, the slot 28 will be closed preventing the dice 30 from returning to chamber 24 from chamber 26.

A diagonal line 60 is also inscribed on the top of container 12 adjacent decorative indicia 14. When the dice 30 are transferred from mixing chamber 24 to display chamber 26, the container 12 should be tilted so that line 60 is substantially horizontal to the body of the person shaking container 12, so the dice 30 will slide to the remote side or corner of chamber 26 making room for an additional die or dice to follow through slot 28 into chamber 26.

While a specific embodiment of a dice shaker has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A device for shaking dice comprising:

a container adapted to receive one or more dice;

a transparent window at one end of said container;

an interior partition within said chamber parallel to said window dividing the interior of said container into a display chamber adjacent said window and a mixing chamber, a slot in said interior partition establishing communication between said mixing chamber and display chamber;

closure means within said container for covering said slot to captively retain one or more dice passed from said mixing chamber to said display chamber in said display chamber adjacent said window;

said closure means including a panel slidably mounted in said container;

said panel including corners with an upright tab extending from each corner thereof in the plane of the panel, plural track means in said container extending parallel to both said partition and to a sidewall of said container perpendicular to said partition with said track means on the interior floor and ceiling of said container receiving selective ones of said tabs for guiding the sliding movement of said panel, and means connected to said panel and including an actuating member extending outside said container for sliding said panel in said track means.

2. A device for shaking dice comprising:

a container adapted to receive one or more dice;

a transparent window at one end of said container;

an interior partition within said chamber parallel to said window dividing the interior of said container into a display chamber adjacent said window and a mixing chamber, a slot in said interior partition establishing communication between said mixing chamber and display chamber;

closure means within said container for covering said slot to captively retain one or more dice passed from said mixing chamber to said display chamber in said display chamber adjacent said window;

said closure means including a panel slidably mounted in said container;

said panel including corners with an upright tab extending from each corner thereof in the plane of the panel, plural track means in said container extending parallel to both said partition and to a sidewall of said container perpendicular to said partition with said track means on the interior floor and ceiling of said container receiving selective ones of said tabs for guiding the sliding movement of said panel, and a lever secured to said panel for sliding said panel in said track means;

said container including an elongated slot in said sidewall, and said lever extending through said slot.

3. A device for shaking dice comprising:

a container adapted to receive one or more dice;

a transparent window at one end of said container;

an interior partition within said chamber parallel to said window dividing the interior of said container into a display chamber adjacent said window and a mixing chamber, a slot in said interior partition extending along one side wall of said container and establishing communication between said mixing chamber and display chamber;

closure means within said container for covering said slot to captively retain one or more dice passed from said mixing chamber to said display chamber in said display chamber adjacent said window;

said closure means including a panel movably mounted in said container;

said panel being flat and substantially covering said slot and said partition in its closed position; and means connected with said panel and including an actuating member accessible outside said container for moving the edge of said panel adjacent said one side wall along a path parallel to the plane of said partition to uncover said slot and for concurrently moving the opposite edge of said panel away from said partition whereby when said panel is moved to uncover said slot the plane of said panel slopes toward said slot.

4. The device of claim 3 including a hole in a surface of said container through which one or more dice are placed in said mixing chamber, and a plug adapted to be received in said hole.

5. The device of claim 3 wherein a portion of said panel adjacent the slot in said partition is thickened and fills the slot in the closed position of the panel.

* * * * *